US006725786B2

(12) United States Patent
Clark

(10) Patent No.: US 6,725,786 B2
(45) Date of Patent: Apr. 27, 2004

(54) PASS-THROUGH TRANSACTION DEAL TRAY WITH A SELF-CLOSING FEATURE

(76) Inventor: Larry G. Clark, 6215 Red Alder Dr., Plainfield, IN (US) 46168

( * ) Notice: Subject to any disclaimer, the term of this patent is extended or adjusted under 35 U.S.C. 154(b) by 0 days.

(21) Appl. No.: 10/068,624

(22) Filed: Feb. 6, 2002

(65) Prior Publication Data

US 2003/0145767 A1 Aug. 7, 2003

(51) Int. Cl.[7] ..... E06B 7/32
(52) U.S. Cl. ..... 109/19; 109/10; 109/13
(58) Field of Search ..... 109/19, 10–13, 109/17; 232/43.1–43.4, 44

(56) References Cited

U.S. PATENT DOCUMENTS

| | | | | | |
|---|---|---|---|---|---|
| 1,583,837 | A | * | 5/1926 | Ickis | 109/19 |
| 1,885,165 | A | | 11/1932 | Willems | 109/19 |
| 2,648,300 | A | | 8/1953 | Beedle | 109/19 |
| 3,145,918 | A | | 8/1964 | Higgins et al. | 232/43.1 |
| 3,298,329 | A | | 1/1967 | Carstens, Jr. et al. | 109/10 |
| 3,429,082 | A | | 2/1969 | Strickland et al. | 52/28 |
| 3,682,113 | A | | 8/1972 | McClellan et al. | 109/19 |
| 4,084,149 | A | | 4/1978 | Driver et al. | 9/66 |
| 4,303,021 | A | * | 12/1981 | Bourlier et al. | 109/19 |
| 4,393,789 | A | | 7/1983 | Glotfelter | 109/19 |
| 4,517,901 | A | | 5/1985 | Clark | 109/19 |
| 4,596,358 | A | | 6/1986 | Hagberg | 232/43.1 |
| 4,640,200 | A | | 2/1987 | Richardson | 109/19 |
| 5,615,624 | A | | 4/1997 | Terry et al. | 109/19 |
| 5,799,589 | A | | 9/1998 | Clark | 109/19 |

FOREIGN PATENT DOCUMENTS

| | | | | |
|---|---|---|---|---|
| CH | 589 211 | | 6/1977 | |
| CH | 589 775 | * | 7/1977 | 109/19 |
| DE | 1 509 671 | | 6/1969 | |
| GB | 1 587 410 | | 4/1981 | |

* cited by examiner

*Primary Examiner*—Anthony Knight
*Assistant Examiner*—John B. Walsh
(74) *Attorney, Agent, or Firm*—Woodard, Emhardt, Moriarty, McNett & Henry LLP

(57) ABSTRACT

A self-locking deal tray for use in a countertop and a transaction barrier. The deal tray has a frame with at least a partially open top and can be secured to the countertop. The deal tray further has a movable receptacle that is movably connected to the front face of the frame. The movable receptacle can then move between lowered position away from the barrier above it and a raised position against the barrier above it. Finally, the deal tray includes a support movably attached to the bottom of the movable receptacle that can be moved between a supine position and a standing position, respectfully corresponding to the receptacle's lowered and raised positions.

14 Claims, 4 Drawing Sheets

PASS-THROUGH TRANSACTION DEAL TRAY WITH A SELF-CLOSING FEATURE

This invention relates generally to deal trays such as those used by cashiers for through-the-wall transactions with customers, and more particularly with a deal tray with a self-closing feature.

An earlier patent of mine is U.S. Pat. No. 4,517,901. This patent discloses a transaction drawer within a housing that can be mounted in a building wall. The housing has a front door. A drawer is glidably mounted in the housing behind the door and has a lid at its top. When the drawer is closed, the lid accommodates access of the cashier to the contents of the drawer, and the front door is closed. A cam on the drawer is operated to raise the lid to an access-excluding position as the drawer is opened, and open the door for access to the drawer by a customer outside the wall. The cam on the drawer and lid have different rates of actuation so that the lid is closed more quickly than the door is opened. This device is not always viable for use in some applications.

There is a need for a less expensive deal tray that can be readily locked closed by an employee at the end of the day or between transactions than is currently available. This invention is one solution that addresses that need.

SUMMARY OF THE INVENTION

In one aspect, this invention is a deal tray for transactions between a location in front of a barrier and a location behind a barrier. The deal tray has a frame with at least a partially open top and at least a partially closed bottom. A receptacle rests in the frame and is movably connected to the front face of the frame. The movable receptacle moves between a lowered position toward the bottom of the frame and a raised position away from the bottom of the frame. A leg is movably attached to the bottom of the receptacle. The leg moves from a supine position when the receptacle is lowered to an erect position when the receptacle is raised.

In another aspect, this invention is an improvement for the combination of a countertop and a transaction barrier. The improvement is a deal tray that is mountable between the external side and internal side of the barrier. The deal tray has a frame with at least a partially open top that can also be secured within the top surface of the countertop. The deal tray further has a movable receptacle that is hingedly connected to the front face of the frame. The movable receptacle can then move between a lowered position away from the barrier above it and a raised position against the barrier above it. Finally, the deal tray includes a support hingedly attached to the bottom of the movable receptacle that can be moved between a supine position and a standing position, respectfully corresponding to the receptacle's lowered and raised positions.

BRIEF DESCRIPTION OF THE DRAWINGS

In the accompanying drawings, forming a part of this specification, and in which like numerals are employed to designate like parts throughout the patent.

DESCRIPTION OF THE PREFERRED EMBODIMENT

Figure 1:
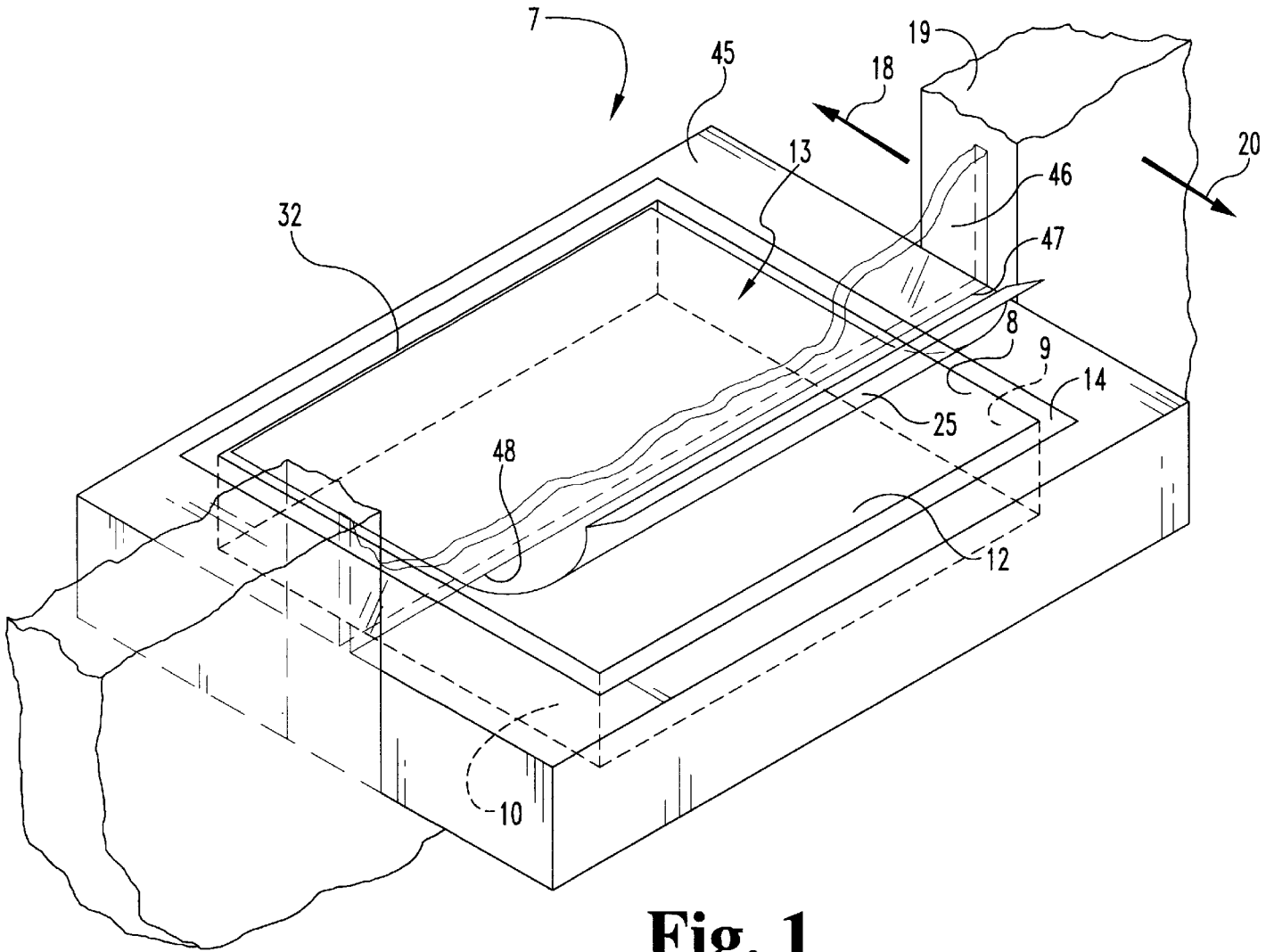
FIG. 1 is a perspective view of the deal tray with the receptacle in the raised or closed position and showing the placement of the deal tray in a countertop in the barrier in a building according to one embodiment of the invention.

For the purpose of promoting an understanding of the principles of the invention, specific language is used to describe the embodiments of this invention that are illustrated in the drawings. Please understand that no limitation of the scope of the invention is intended by this description. Any alteration and modification to the illustrated device that would normally occur to one of average skill in this art are also included.

As used in this patent the term "arcuate" is used with its ordinary meaning of bent or curved or bowed.

As used in this patent the term "clearance" is used with its ordinary meaning of the distance by which one object clears another.

As used in this patent the term "concave" is used with its ordinary meaning of curved or rounded inward like the inside of a bowl.

As used in this patent the term "frame" is used with its ordinary meaning of an open case or structure made for admitting, enclosing, or supporting something.

As used in this patent the term "leg" is used with its ordinary meaning of structure serving as a support or prop.

As used in this patent the term "median plane" is used with its ordinary meaning of a vertical longitudinal plane that divides an object into right and left portions.

As used in this patent the term "receptacle" is used with its ordinary meaning of structure that can receive and contain or hold something.

As used in this patent the term "standing" is used with its ordinary meaning of upright on the feet or base: erect.

As used in this patent the term "supine" is used with its ordinary meaning of lying on its back or with a face generally upward.

Figure 2:
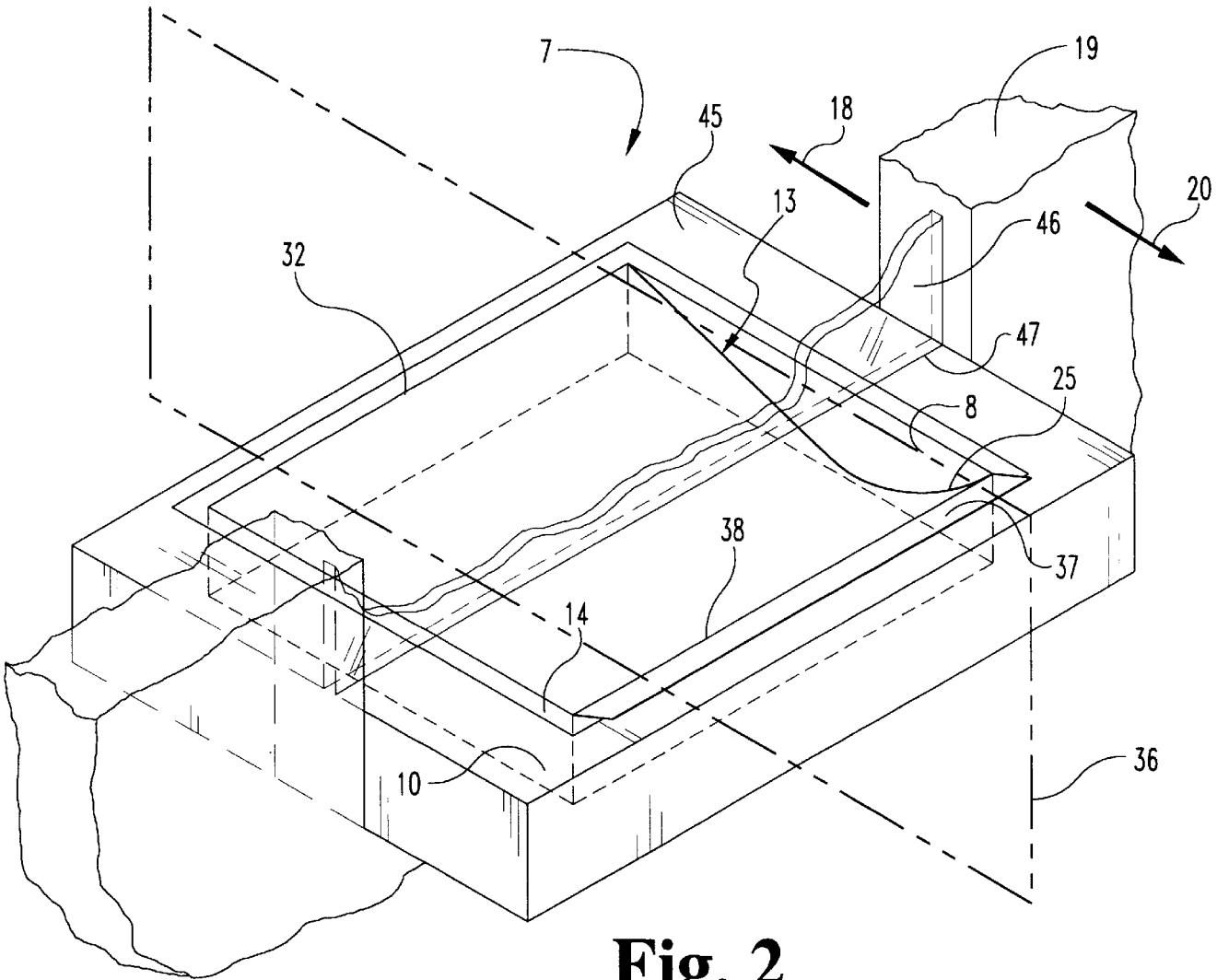
FIG. 2 is a perspective view of the deal tray with the receptacle in the lowered or open position and showing the placement of the deal tray in a countertop in the barrier in a building according to one embodiment of the invention.

Referring to the attached drawings, FIGS. 1 and 2 depict a preferred example of the deal tray 7 when it is respectfully in a raised position and in a lowered position according to the principles of the invention. One feature of deal tray 7 readily noted is frame or housing 8. See also FIGS. 3–5. Frame 8 preferably includes lateral sides 9 and 10, front face 11, bottom 12, an open top 13, and a back face 15. Frame 8 also preferable includes a flange 14 that laterally extends from the top edges of front face 11, lateral sides 9 and 10, and back face 15.

Figure 3:
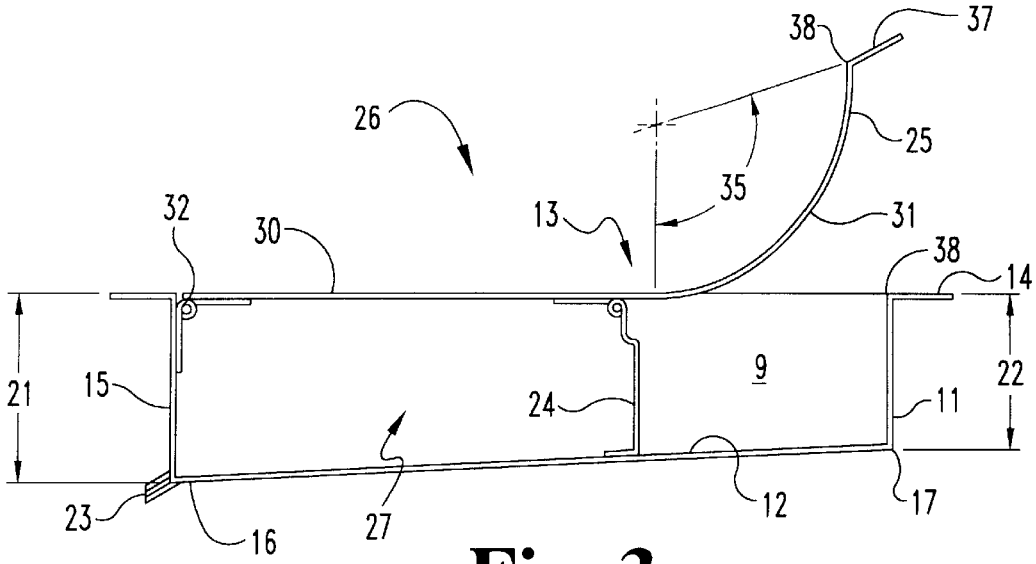
FIG. 3 is a cross-sectional view of the deal tray with the receptacle in the raised or closed position according to one embodiment of the invention.
Figure 4:
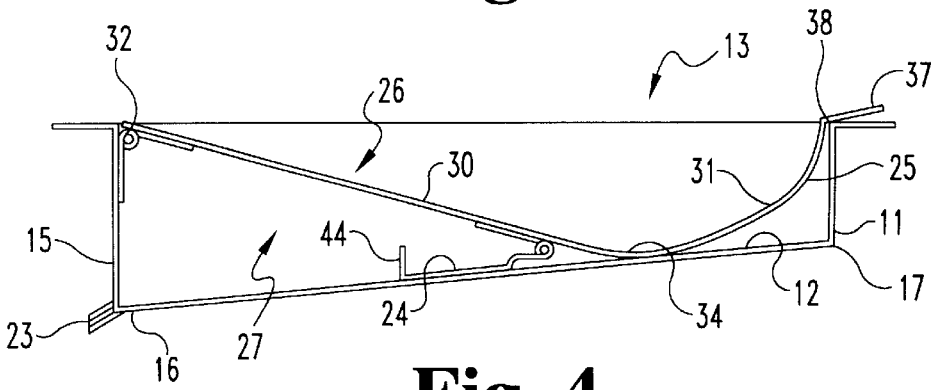
FIG. 4 is a cross-sectional view of the deal tray with the receptacle in the lowered or open position according to one embodiment of the invention.
Figure 5:
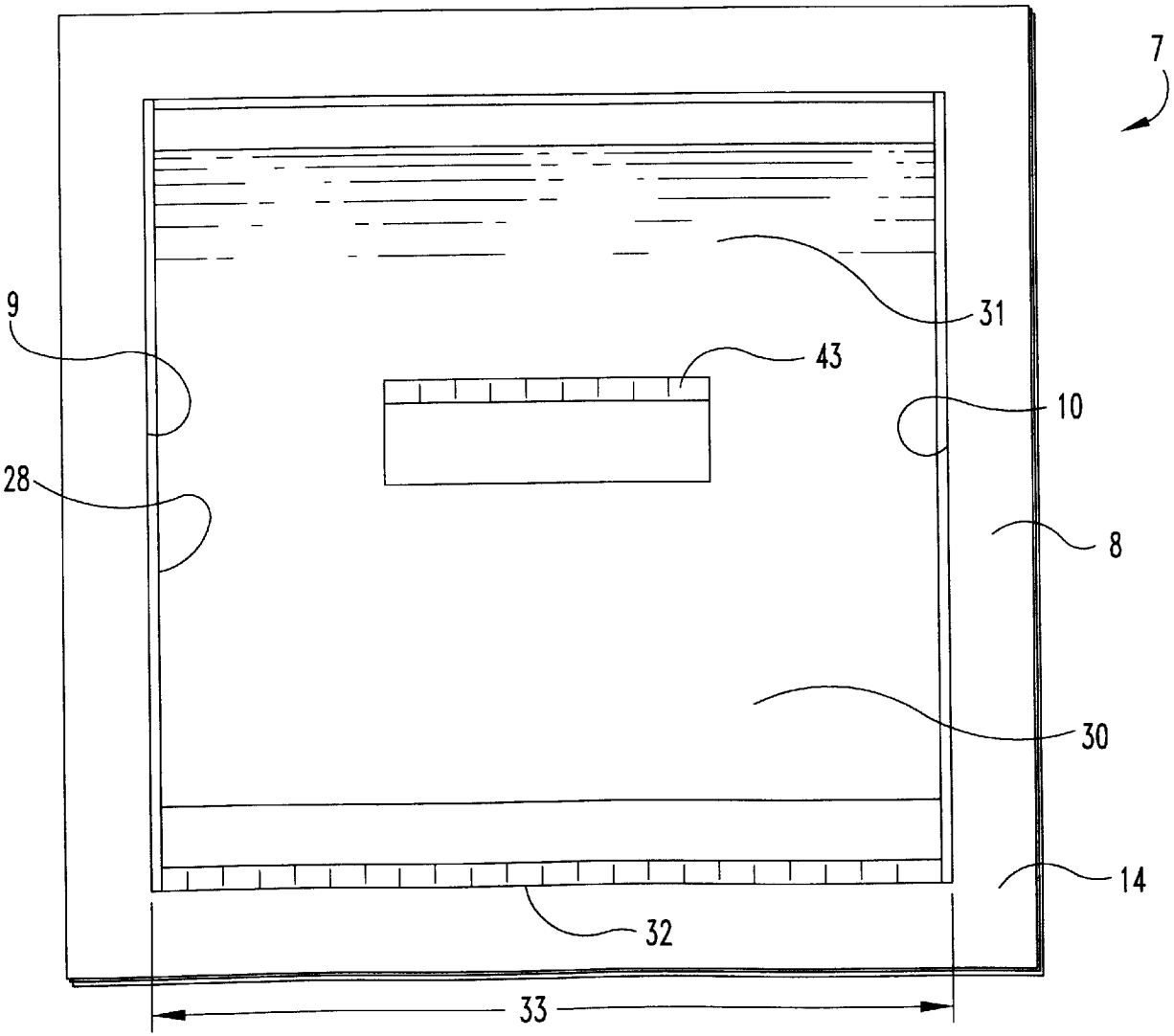
FIG. 5 is a plan view of the deal tray according to one embodiment of this invention.

Referring to FIGS. 3 and 4, bottom 12 is preferably not horizontal. Rather, bottom 12 is preferable tilted so that any rainwater, which happens to fall into frame 8 drains toward back face 15 on the exterior side 18 of barrier 19 instead of draining toward front face 11 on the interior side 20 of barrier 19. This optional feature is preferably accomplished during the manufacture of frame 8 by constructing front face 11 of comparatively less width 22 than the width 21 of back face 15 and appropriately tapering lateral sides 9 and 10 in a fashion to compensate for a bottom 12 that has a slight incline or upward curve from the bottom edge 16 of back face 15 to the bottom edge 17 of front face 11. Frame 8 then includes a passageway 23 preferably located in the lowermost portion of frame 8 through which the rainwater may drain out from frame 8.

FIGS. 1–5 depict a frame 8 with a fully closed bottom and a fully open top 13, however, this is not necessary to practice the invention protected by this patent. The top 13 need only be partially or sufficiently open to allow a customer standing on the exterior side 18 to pass items to the interior side 20. Meaning, the top 13 possibly may be partially obstructed by accessories, a cover, or other structures and still practice the principles of this invention. The bottom 12 need only be partially or sufficiently closed so that leg or support 24 has some structure or structures on which it may stand when leg 24 is in an extended position. For example, such structure could even be provided by the barrier 19 in which deal tray 7 is mounted and still practice the principles of this invention.

Frame 8 may be constructed from many materials including those materials particular suitable for exposure to the elements of weather, such as stainless steel or fiber-reinforced plastics. For example, a highly preferable material is 16- or 10-gauge stainless steel.

Deal tray 7 further includes a receptacle 25. Referring to the figures, receptacle 25 has a top surface 26, a bottom surface 27, lateral edges 28 and 29, a front portion 30, and a back portion 31. Receptacle 25 is generally sized to fit within frame 8. The front portion 30 of receptacle 25 is movably attached to the front face 11 of frame 8 by a hinge 32. As shown, hinge 32 is preferably of the piano hinge variety and extends the entire width 33 of receptacle 25. And although a piano hinge is shown, it is contemplated by this invention that one may also use similarly operating structures such as a flexible membrane of plastic or rubber secured between receptacle 25 and front face 11 or use multiple hinges, rather than a single hinge, attached over the width of receptacle 25 to the front face 11.

The front portion 30 of receptacle 25 is preferably substantially flat. When in its lowered position shown in FIG. 4, the flat surface allows items to side down receptacle 25 to the bottom 34 of receptacle 25, preferably on the inside 20 of barrier 19. (FIG. 2) The flat surface also provides a cover that portion of open top 13 of the outside 18 of barrier 19 when receptacle 25 is in a raised position. (FIG. 1) And although a substantially flat front portion 30 is shown, it is contemplated that the surface of front portion 30 could also be convex as well as concave and still accomplish the principles of the invention. In other words, it is not an absolute requirement that front portion 30 be flat in order to practice this invention. Most any surface configuration over front portion 30 would suffice.

The back portion 31 of receptacle 25 preferably includes a concave curved portion 35. In one embodiment of this invention, the concave curved portion resides in a medial plane 36, the cross-section of which being shown in FIGS. 3 and 4. Relevant here, although receptacle 25 is shown only curved along this medial plane, it is also contemplated that back portion 31 of receptacle 25 could be simultaneously curved along other planes as well. Allowing, for example, the back portion to resemble the shape of a parabola or bowl and still practice the principles of this invention. In other words, preferably back portion 31 simply includes some form of an arcuate surface to receive items sliding down the front portion 30 of receptacle 25 into back portion 31.

Receptacle 25 further includes a handle 37. Handle 37 is preferably attached to the proximal end 38 of receptacle 25. In one embodiment, handle 37 is a flange that extends over the entire width 33. This flange then rests upon the top edge 38 of back face 11 when receptacle 25 is placed it is lowered position. In other embodiments, handle 37 may be simply attached to the top surface 26 of receptacle 25.

Figure 6:
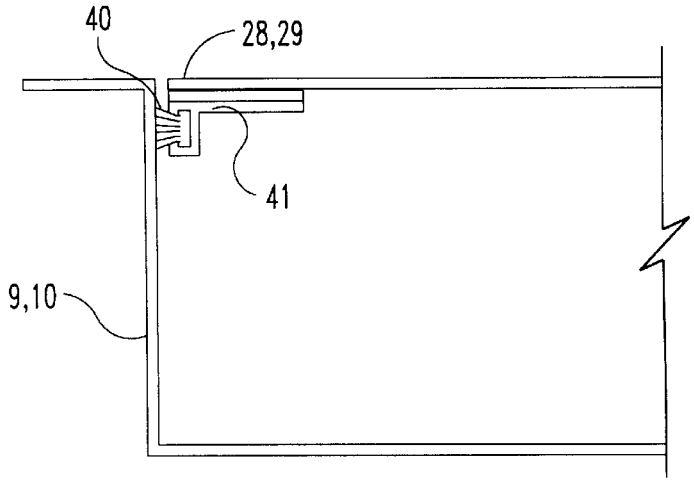
FIG. 6 is a fragmentary view showing one embodiment of a slidable sealing engagement according to one embodiment of this invention.

The respective clearance between the lateral edges 28 and 29 and the lateral sides 9 and 10 can be most any that will allow receptacle 25 to pass inside frame 8. In one embodiment nor more than one-half of an inch is contemplated. In another embodiment no more than one-quarter of an inch is contemplated. Be that as it may, it is further contemplated that one could also use a weather-tight seal 40 between lateral edge 28 and side 9 and a weather-tight seal 40 between lateral edge 29 and side 10. This seal 40 could be made of an appropriate elastomeric material such as silicone rubber, natural rubber, or nylon fibers, and could be attached along the lateral edges 28 and 29 to ride against sides 9 and 10. A cross-sectional view of such an arrangement is shown in FIG. 6. In this arrangement seal 40 is held in bracket 41 and bracket 41 is attached along the length of lateral edges 28 and 29 while allowing the seal 40 to extend over the clearance between receptacle 25 and frame 8 to contact its lateral edges 9 and 10.

Similar to frame 8, receptacle 25 may be constructed from many materials including those materials particular suitable for exposure to the elements of weather, such as stainless steel or fiber-reinforced plastics. For example, a highly preferable material is 16 or 10-gauge stainless steel.

Deal tray 7 further includes a leg or support 24. Referring to FIGS. 3 and 4, leg 24 resides between the bottom surface 27 of receptacle 25 and the bottom 12 of frame 8. Leg 24 is movably attached to the bottom surface 27, which as shown, is most preferably done with hinge 43. But although a hinge is shown, it is further contemplated that other methods of connection could be used, for example, one could also use a pivot, a universal joint, or swivel connection between leg 24 and receptacle 25. In one embodiment, leg 24 is substantially wide, being made of one continuous piece. In another embodiment, leg 24 could include multiple legs attached to the bottom surface 27 of receptacle 25 and be either attached to operate in unison or unattached to operate independently. Leg 24 is designed to move from a supine position as shown in FIG. 4 and a standing position shown in FIG. 3. Leg 24 further preferably includes a foot 44 at its bottom to assist in maintaining leg 24 in a standing position. Leg 24, like most of the deal tray 7, may be constructed from many materials including those materials particular suitable for exposure to the elements of weather, such as stainless steel or fiber-reinforced plastics. For example, a highly preferable material is stainless steel.

Referring to FIGS. 1 and 2, deal tray 7 is mounted within a building by placing deal tray 7 within a countertop 45 that in turn resides in an opening 47 in one of the barriers 19 of the building. Barrier 19 preferably includes a clear but bulletproof portion 46 that allows one to see from the internal side of the booth to the external side and vice versa. Materials and methods of the construction of such countertops and barriers are well known in the art.

A final aspect of the present invention is the manner in which deal tray 7 closes preventing access from the exterior 18. In its lowered or open position (FIGS. 2 and 4), receptacle 25 has a comparatively lower position in frame 8 to allow for passage of items from the external side 18 to the internal side 20 of barrier 19 over the top of receptacle 25. While in this lowered position, leg 24 is supine, resting preferably on its side against the bottom 12 of frame 8.

When the transaction is complete, the clerk locks deal tray 7 closed by lifting receptacle 25 against the bottom 48 of opening 47. Once lifted to this position, leg 24 moves or swings to a standing position (FIG. 1 or 3) between receptacle 25 and the bottom 12 of frame 8 to continue holding receptacle 25 against barrier 19. The deal tray now prevents access from the exterior 18 because the front portion 30 residing outside barrier 19 is still in the confines of frame 8, leaving only the clearance, if any, between the lateral edges 28 and 29 of receptacle 25 and the lateral sides 9 and 10 of frame 8 to allow passage to the inside. The clerk on the inside 20 of barrier 19 can reopen deal tray 7 by moving leg or legs 24 from its standing position and relocating receptacle 25 to its open position with leg or legs 24 back in a supine position.

While the invention has been illustrated in the drawings and described in detail in the description, these are to be considered as illustrative and not restrictive. It must be understood that preferred embodiments have been shown and described and that all changes and modifications that come within the spirit of the invention are included where described by the following claims.

I claim:

1. A deal tray for transactions between a location in front of a barrier and a location behind a barrier, comprising:

a frame, said frame having at least a partially open top, at least a partially closed bottom, a front face, lateral sides, a back face having a top edge;

a receptacle, said receptacle having a top surface, a bottom surface, lateral edges, a substantially flat front portion, and a back portion said back portion of said receptacle includes a concave curved portion;

a back face with a top edge back face; and a leg, wherein said front portion of said receptacle is movably connected to the front face of said frame; said receptacle is movable between a lowered position toward the bottom of said frame and a raised position away from the bottom of said frames; said receptacle rests against said top edge of said back face of said frame when said receptacle resides in the lowered position; said leg is movably attached to the bottom surface of said receptacle; and said leg is located between said bottom of said frame and said bottom surface of said receptacle.

2. The deal tray of claim 1, wherein said receptacle has a median plane and the back portion of said receptacle includes a concave curve along said median plane.

3. The deal tray of claim 2, wherein the back portion of said receptacle includes an arcuate surface.

4. The deal tray of claim 3, wherein the bottom of said frame is inclined from the front face of said frame and wherein the lowermost point of the bottom of said frame includes a passageway whereby rainwater falling on the deal tray may drain out from the deal tray through the passageway.

5. For the combination of a countertop and a barrier residing above the countertop, both having an external side and an internal side, the improvement comprising:

a deal tray mountable between the external side and internal side of said barrier, said deal tray including a frame fixedly secured within said countertop and beneath said barrier, said frame having at least a partially open top, a bottom, a front face, a back face and opposing sides; said deal tray including a movable receptacle having a top surface, a bottom surface, a front portion, and a back portion, and wherein the front portion of said movable receptacle is hingedly connected to the front face of said frame; said movable receptacle movable between lower position away from said barrier residing above the movable receptacle and a raised position contacting said barrier; said deal tray including a support hingedly attached to the bottom of said movable receptacle, said support movable between a supine position and a standing position.

6. The combination of claim 5, wherein said frame includes a back face with a top edge and said movable receptacle rests against the top edge of said back face when said movable receptacle resides in said lowered position.

7. The combination of claim 5, wherein the front portion of said movable receptacle is substantially flat on the exterior side of said barrier when the movable receptacle is placed in said raised position.

8. The combination of claim 5, wherein the back portion of said movable receptacle includes a concave curved portion.

9. The combination of claim 5, wherein said movable receptacle has a median plane and the back portion of said movable receptacle includes a concave curve along said median plane.

10. The combination of claim 5, wherein the back portion of said movable receptacle includes an arcuate surface.

11. The combination of claim 5, wherein there is no more than a half of one inch of clearance between a lateral edge of said movable receptacle and the corresponding lateral side of said frame when said movable receptacle resides in said lowered position.

12. The combination of claim 5, wherein there is no more than a quarter of one inch of clearance between a lateral edge of said movable receptacle and the corresponding lateral side of said frame when said movable receptacle resides in said lowered position.

13. The combination of claim 5, wherein the lateral edges of said movable receptacle include a slidable sealing engagement against the lateral sides of said frame.

14. The combination of claim 5, wherein the bottom of said frame is inclined from the front face of said frame and wherein the lowermost point of the bottom of said frame includes a passageway whereby rain water falling on the deal tray may drain out from the deal tray through the passageway.

* * * * *